United States Patent [19]

Hata et al.

[11] Patent Number: 4,675,470

[45] Date of Patent: Jun. 23, 1987

[54] ELECTRIC POWER CABLE

[75] Inventors: Ryosuke Hata; Shosuke Yamanouchi; Masayuki Hirose, all of Osaka; Toshiya Yoshii; Kenji Tsunashima, both of Shiga; Satoshi Horiuchi, Shiga, all of Japan

[73] Assignees: Sumitomo Electric Industries; Toray Industries, Inc., both of Japan

[21] Appl. No.: 749,071

[22] Filed: Jun. 26, 1985

Related U.S. Application Data

[63] Continuation-in-part of Ser. No. 743,884, Jun. 12, 1985, abandoned, which is a continuation of Ser. No. 619,423, Jun. 11, 1984, abandoned.

[30] Foreign Application Priority Data

Jun. 26, 1984 [JP] Japan ..... 59-132451

[51] Int. Cl.[4] ..... H01B 9/06

[52] U.S. Cl. ..... 174/25 R; 174/120 FP

[58] Field of Search ..... 174/25 R, 25 C, 26 R, 174/25 P, 120 FP

[56] References Cited

U.S. PATENT DOCUMENTS

| | | | |
|---|---|---|---|
| 3,450,968 | 6/1969 | Cox | 174/25 R |
| 3,484,664 | 12/1969 | Liddicoat | 174/25 R |
| 3,775,549 | 11/1973 | Matsuda et al. | 174/25 R |
| 3,844,860 | 10/1974 | Edwards | 174/25 R X |
| 4,237,334 | 12/1980 | Kojima et al. | 174/25 R |
| 4,571,357 | 2/1986 | Hata | 174/25 R X |
| 4,602,121 | 7/1986 | Priaroggia | 174/120 FP X |

FOREIGN PATENT DOCUMENTS

| | | | |
|---|---|---|---|
| 95292 | 8/1978 | Japan | 174/25 R |
| 109406 | 8/1981 | Japan | 174/25 R |
| 1045527 | 10/1966 | United Kingdom | 174/25 R |

OTHER PUBLICATIONS

Cheng, F. S. et al.; Effect of Impregnant on the Electrical and Mechanical Properties of Polypropylene Paper; Wire and Wire Products; May 1972; pp. 57-63.

*Primary Examiner*—Arthur T. Grimley
*Assistant Examiner*—Morris H. Nimmo
*Attorney, Agent, or Firm*—Sughrue, Mion, Zinn, Macpeak, and Seas

[57] ABSTRACT

An oil-immersion electrically insulated cable of high performance is constructed by wrapping a conductor with insulation formed by winding on the conductor polypropylene film having a density in the range of 0.905 to 0.915 g/cm$^3$, a birefringence in the range of 0.020 to 0.035, a ratio of strengths in two axial directions (tensile strength in the longitudinal direction/tensile strength in the lateral direction) in the range of 5 to 15, and impregnating the insulating layer with an insulating oil, preferably DDB oil.

47 Claims, 18 Drawing Figures

ELECTRIC POWER CABLE

This is a continuation-in-part of application Ser. No. 743,884 filed June 12, 1985, now abandoned, which is a continuation of application Ser. No. 619,423 filed June 11, 1984, now abandoned.

BACKGROUND OF THE INVENTION

This invention concerns and relates to improvements in an electrically insulated cable impregnated with insulating oil.

For forming oil-impregnated insulating layers (dielectric insulation) for an oil-immersion type electric cable, electrically insulating paper has heretofore most often been used. Recently, however, polypropylene film in the form of a tape has been used to construct such insulting layers. In addition to far exceeding electrically insulating paper in terms of dielectric breakdown voltage, this film has several advantages such as a low dielectric loss tangent and a dielectric constant approximating the dielectric constant of the insulating oil.

The conventional polypropylene film insulated cable, however, has a disadvantage that swelling with the insulating oil occurs to an exceptionally great extent. Therefore, the use of polypropylene film has entailed various restrictions. For example, when a cable is wrapped in polypropylene film and the resultant polypropylene insulated cable is immersed in insulating oil, the film swells so as to increase the pressure on the core of the cable and consequently deprive the cable of its flexibility and impair the fluidity of the insulating oil between the adjacent insulating film layers. As a measure of avoiding this trouble, the film may be more loosely wound around the conductor. When the film is loosely wound, however, there is a possibility of the film slipping out of place or being wrinkled.

Another disadvantage suffered by the conventional polypropylene film insulated cable is that, where the tapes of the insulating film overlap, the fluidity of the insulating oil between the adjacent films is liable to be low, possibly to the extent of inducing dielectric breakdown because of insufficient roughness of the surface of the polypropylene film.

When polypropylene film is impregnated with any of the alkylbenzene type oils which are preponderantly used as insulating oils in OF cables of the EHV class, the film swells as the temperature of the cable increases so that the film increases in thickness, possibly to the extent of notably increasing the interface pressure between the overlapping plies of film, causing the film to sustain rupture such as due to thermal expansion or contraction of the cable, and moreover forcing upper plies of the film to fall into gaps formed between turns of adjacent lower plies of the film and consequently causing damage. The result is generally degraded electrical characteristics.

SUMMARY OF THE INVENTION

Accordingly, a primary object of the invention is the provision of an oil-immersion electrically insulated cable with low dielectric loss and enjoying excellent dielectric strength by the provision of insulation formed on a conductor by winding at least a sheet of improved polypropylene film on the conductor, thereby eliminating the above-noted defects, including excessive swelling. Another object of the invention is to provide an oil-immersion electrically insulated cable of the type discussed above which has insulation formed on a conductor by winding a combination of at least a sheet of polypropylene film and at least a sheet of kraft paper, thereby, in addition to the elimination of swelling problem, eliminating insufficient fluidity of the insulating oil in the insulation.

This invention accomplishes the objects noted above by providing a cable which is characterized by having insulation formed of polypropylene film of an oil-immersion electric insulation grade having a density in the range of 0.905 to 0.915 g/cm$^3$, a birefringence in the range of 0.020 to 0.035, and a ratio of strengths in two axial directions (tensile strength in the longitudinal direction/tensile strength in the lateral direction) in the range of 5 to 15.

Other objects and characteristics of the invention will become apparent from the further disclosure of this invention to be made in the following detailed description of preferred embodiments and with reference to the accompanying drawings.

BRIEF DESCRIPTION OF THE DRAWINGS

FIGS. 1B and 1C are sectional views of typical insulation structures according to the present invention and FIG. 1D is a cross section of a typical laminate structure;

DESCRIPTION OF THE PREFERRED EMBODIMENTS

Figure 1A:
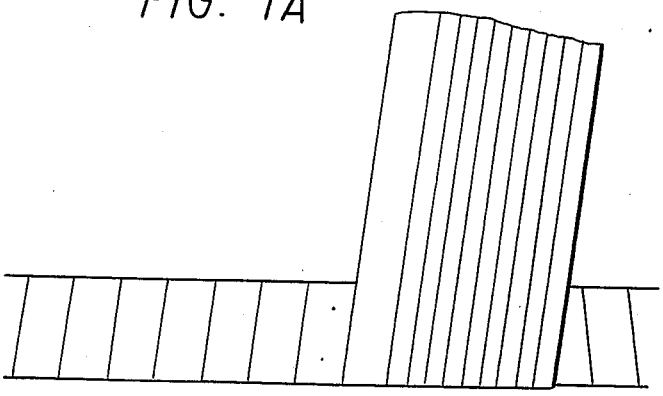
FIG. 1A is a schematic representation of an insulating layer winding operation.

The term "polypropylene" (hereinafter referred to as "PP" for short) as used herein means polypropylene of a grade having an isotacticity of at least 90%, preferably at least 95%, and more preferably at least 97%, and a melt index in the range of 0.5 to 40 g/10 minutes, preferably 1 to 20 g/10 minutes. An isotacticity below the lower limit mentioned above is undesirable because such increases the degree of swelling with the insulating oil. If the melt index is below the lower limit mentioned above, the amount of swelling with the insulating oil also increases. On the other hand, if the melt index is above the upper limit mentioned above, the amount of the polymer dissolved in the insulating oil is increased, and consequently the viscosity of the insulating oil rises. In the PP species of the grade described above, those materials which prove suitable for the manufacture of the cable of this invention fulfill the requirement that the temperature of melt crystallization ($T_{mc}$) is in the range of 105° to 120° C., preferably 108° to 118° C. A PP species having a $T_{mc}$ exceeding the upper limit mentioned above exhibits an inferior film-forming property and produces a homogeneous film with difficulty and, consequently, aggravates dielectric faults.

The PP film to be used for the cable of this invention is required to have a density in the range of 0.905 to 0.915 g/cm$^3$, preferably 0.907 to 0.912 g/cm$^3$. If the density is below the lower limit mentioned above, the degree of swelling with the insulating oil is increased. Conversely, if the density is above the upper limit mentioned above, the PP film becomes brittle and the mechanical strength of the insulating layer of the cable is insufficient. If the birefringence is less than the lower limit mentioned above, the swelling of the PP film with the insulating oil increases beyond the tolerable extent. If it exceeds the upper limit, the PP film is liable to sustain cracks which could cause dielectric breakdown. Such a PP film, therefore, does not meet the objects of this invention. The ratio of strengths in the two axial directions of the PP film to be used for the cable of the invention, namely, the quotient of the tensile strength of the film in the longitudinal direction divided by the tensile strength thereof in the lateral direction, is required to be in the range of 5 to 15, preferably 7 to 12. If this ratio is less than the lower limit mentioned above, the swelling of the PP film with the insulating oil increases beyond a tolerable extent. Conversely, if this ratio exceeds the upper limit, the differences of properties exhibited by the PP film in axes of varying directions increase beyond a tolerable extent, and consequently the workability of the PP film while being wound on the cable to form the insulation is notably degraded (for example, by stretching, wrinkling, or rupturing).

Now, a typical method for producing the film to be used for the cable of this invention will be described by way of illustration. The PP resin is melted, extruded in the form of a sheet through an extrusion die, wound on a cooling drum, and allowed to cool and solidity. The PP sheet thus obtained is passed between a set of reducing rolls and rolled with a rolling ratio (the quotient of the thickness of the sheet before rolling divided by the thickness of the sheet after rolling) in a range of 5 to 12, preferably 7 to 10.

The pressure of rolling is desirably in a range of 10 to 3000 kg/cm, preferably 100 to 1000 kg/cm, and the temperature of the reducing rolls is desirably in a range of 60° to 160° C., preferably 80° to 150° C. The PP sheet can be easily rolled uniformly at a high rolling ratio by wetting the surface of the PP sheet with a suitable liquid (such as water, an aqueous solution of surface active agent, alkylene-glycol, polyalkylene-glycol, glycerin, or an electrically insulating oil) while the PP sheet is entering the reducing rolls.

The PP film obtained by the foregoing rolling tretment (the film generally having a thickness in a range of 10 to 300 microns) is again heated to 100 to 150° C. and subjected to heat treatment at this temperature for a period of 1 to 20 seconds until it slackens by 0.5 to 10% of the original size in the longitudinal direction.

The present invention is characterized by possessing the features described above. The oil-immersion electrically insulated cable of the present invention can be obtained in a more desirable form by limiting the ratio of thermal shrinkage of the PP film in the longitudinal direction to the range of 0.1 to 5%, preferably 0.5 to 3%. If the ratio of thermal shrinkage exceeds the upper limit mentioned above, a disadvantage results in that the insulating layer is liable to tighten and consequently wrinkle. If this ratio is less than the lower limit, the film in the insulating oil is liable to stretch in the longitudinal direction and the insulating layer wound on the cable slacken. A typical method for limiting the ratio of thermal shrinkage in the longitudinal direction resides in heating the PP film produced by the method described above to a temperature in a range of 80° to 140° C., preferably 90° to 130° C., and retaining the film at this temperature for a period of 0.5 to 50 hours, preferably 1 to 20 hours, with the film held in a tense state or allowed to slacken by 0.1 to 5% of the original size in the longitudinal direction. By this aging heat treatment, the ratio of thermal shrinkage in the longitudinal direction can be confined within the range of 0.1 to 5%, preferably 0.5 to 3%.

The thickness of the PP film sheet is limited to the range of 70 to 300 microns for the following reason. If the thickness is smaller than 70 microns, there is a fair possibility that the PP sheet will sustain fracture and consequently fail to provide a mechanical strength required for permitting the wrapping the PP tape around a conductor to produce a good insulating layer, and, in the finished OF cable, fail to retain a strength necessary for enabling the cable to resist flexing and cause the resultant insulating layer to sustain abnormalities such as wrinkles, dents, and collapses, which adversely affect the electrical properties of the cable.

Generally, the required thickness of the insulation is obtained by adjusting the number of plies of film tape wrapped on the conductor. If the thickness of the tape is small, the number of plies of the tape is proportionally increased, with the result that the size of the tape wrapping machine must be increased and the amount of work involved in mounting, replacing, and slicing the film tapes increased. If the thickness of the PP film exceeds 300 microns, the PP tape has an excessively high stiffness such that the tape, when being wound on the conductor to produce an insulating layer thereon, offers resistance in conforming to the contour of the cylindrical shape of the conductor and, in the produced OF cable, gives rise to abnormalities such as separation in the insulating layer and irregular distribution of gaps formed between edges of adjacent turns of the tape, which tends to adversely affect the electrical properties of the cable as a whole.

Generally, for the formation of an insulating layer in a cable, the film tape is wound on the conductor in such a manner as to permit the occurrence of gaps between edges of adjacent turns of film tape. Thus, the thickness of oil layers formed in such gaps increases with the thickness of the tape. In an OF cable, the electrical strength of the oil layer is lower than the insulating strength of the tape portion. The fact that the oil layers notably increase in size, therefore, does not prove very favorable.

In the light of the various conditions described above, OF cable is produced by preparing PP films of varying sheet thicknesses in the range of 70 to 300 microns, cutting these PP films into PP tapes of a suitable width, winding on the inner side of the insulation (the side bordering on the conductor and, therefore, experiencing severe electrical stress) PP tapes of smaller thickness, which are rather inferior mechanically but quite superior electrically, and, on the outer side of the insulating layer (the side where the electrical stress is less toward the outside and the effects of flexing exerted thereon increase toward the outside), PP tapes of greater thickness, which are rather inferior electrically but quite superior mechanically.

The term "kraft paper" or "electrically insulating paper" as used herein means ordinary insulating paper which has been conventionally used in OF cables of the EHV class. The thickness of the kraft paper to be used in the cable of this invention is limited to the range of 70 to 300 microns for the same reasons given above with respect to the thickness of the PP film.

Regarding the insulating oil for use in the cable of the invention, the inventors have found that alkylbenzenes containing an aromatic ring, particularly DDB (dodecyl-benzene), which is commonly used in cables, best suits the purposes of the invention. Generally, the following conditions are adopted as criteria for selecting the insulating oil:

(A) The oil should be readily available at low cost.

(B) The oil should possess excellent and stable electrical properties.

(C) The oil should be highly compatible with the component materials of the insulating layer of the cable. Specifically, in the case of the invention, the oil should be amply compatible with the PP film.

Regarding conditions (A) and (B), DDB proves to be an ideal insulating oil. With respect to condition (C), however, DDB is not ideal in that it causes swelling of the PP film.

Generally, the degree of compatibility between a film and insulating oil is determined by their respective SP (solubility parameter) values; the similarity between the film and the insulating oil in a particular combination increases and the ability of the insulating oil to swell the film also increases as the SP values of the film and the insulating oil approach each other. Both PP and DDB have SP values approximating 8. Thus, their combination has been heretofore held to be less desirable than the other combinations, such as PP and polybutene oil or PP and silicone oil, because it has high mutual compatibility and entails a high degree of swelling.

After much study in this respect, the inventors have found that, since the swelling of the PP film by the insulating oil is caused by this oil penetrating the amorphous phase of the film, the fortification of the amorphous phase, which constitutes one electrically weak point of the PP film, renders the lubricating oil in the combination susceptible to heavy swelling of the PP film more desirable from the electrical point of view. Moreover, DDB proves all the more desirable electrically in the sense that it possesses a benzene ring which causes it to excel in gas absorbing properties and resistance to corona discharge. According to the inventor's studies, the impulse breakdown value of one PP film layer, with the value in the combination with DDB taken as unity (1), is about 0.8 in the combination with silicone oil. This trend applies to the AC breakdown strength of the PP film. For the outstanding electrical properties of DDB in combination with the PP film to be retained intact without any sacrifice of compatibility of the DDB with the PP film, the following solution has been devised:

Since, as described above, although impregnation of the PP film with DDB is advantageous from the standpoint of electrical properties, the cable is left standing at the maximum expected actual working temperature (generally in a range of 85° to 95° C.) for 24 to 48 hours to allow the PP film to swell to saturation prior to the shipment of the cable. This conditioning is effective to ensure the cable possesses good electrical properties from the outset of its service.

Through a study of the PP film, it has been ascertained that the amount of swelling of the PP film with DDB can be restrained by optimizing the film's density, birefringence, and ratio of strength in two axial directions within the ranges mentioned above. To be specific, actual measurements indicate that the ratio of increase in the thickness of the film by swelling in the present combination of PP film and DDB is one-half that in the combination of homo-casting PP film and DDB.

To remedy this insufficiency, the surfaces of either or both the draft paper and PP film are embossed to produce bosses of a size sufficient for absorbing an increase of the thickness of the PP film due to swelling, preventing the pressure within the layer of the insulating tape from abnormally rising, and maintaining the fluidity of the lubricating oil.

When one or both surfaces of the PP film and the kraft paper to be used in the cable of the invention are coarsened by embossing, the surface roughness $R_{max}$ (maximum diameter of surface pits) thus produced is required to be in a range of 1 to 50 microns, preferably 2 to 40 microns. If the surface roughness is less than the lower limit mentioned above, the amount of swelling of the PP film to be absorbed by the bosses is insufficient and the fluidity of the insulating oil in the layer is deficient, thereby inducing dielectric breakdown. Conversely, if the surface roughness exeeds the upper limit mentioned above, the PP film may be impaired by the embossing treatment and the bosses formed occupy too much volume and therefore continue their existence even after the swelling of the film, with the possible result that oil gaps may occur between overlapping film tapes, which in effect degrades the electrical strength of the layer.

The coarsening of the surface of the PP film may be effected by an embossing treatment, for example. To be specific, the PP film of the invention is passed between embossing rolls held at 90° to 140° to coarsen either or both of the opposite surfaces of the PP film, with the surface roughness $R_{max}$ falling in the range of 1 to 50 microns, preferably 2 to 40 microns.

For the production of the film for use in the cable of the present invention, the combination of rolling and embossing treatment proves to be most desirable. Optionally, other methods may be used. For example, the rolling treatment of the aforementioned combination may be replaced by a combination of rolling and stretching treatment or by a stretching treatment using closely spaced rolls. Also, the embossing treatment of the aforementioned combination may be replaced by a sand blasting process or etching process to effect the desired surface coarsening.

For the purpose of coarsening the surface of the kraft paper, an embossing treatment with embossing rolls is most desirable. Otherwise, a process of spraying water drops may be utilized.

As the number of sheets of the inventive PP film superposed on the insulating layer is increased, there are obtained improvements in the dielectric loss tangent (tan δ) and dielectric constant (ε), in addition to such advantages as lowered swelling of the film with the insulating oil, improved fluidity of the insulating oil within the insulating layer, improved mechanical properties of the insulating layer, enhanced workability of the PP film when the film is wound on the conductor, and fewer occurrences of excessive tightening or loosening of the winding of the layer. Consequently, the cable which is obtained is suitable for use in HEV through UHV class service at voltage of 275 to 1000 KV, and is particularly well-adapted for use in the UHV class.

The alternate winding of kraft paper and PP film is essential for the manufacture of the cable of this invention for the following two reasons: First, this winding provides the produced cable with improved mechanical strength which a cable insulated exclusively with PP film does not easily attain. Secondly, the interposition of kraft paper containing a polar group between the opposed surfaces of the PP film and the distribution thereof throughout the entire insulation serves to improve various electrical strengths, particularly impulse strength, and most especially, positive impulse strength.

The thermal expansion coefficient of kraft paper is extremely small, in fact, about two orders of magnitude lower than the thermal expansion coefficient of PP film. The compression coefficient of kraft paper in the direction of thickness is small compared with that of PP film. When a plurality of sheets of kraft paper are superposed and exposed to changes of temperature due to load variation, the kraft paper exhibits an extremely high flexibility. When the kraft paper is cut into tapes, the edges faces of the tapes are very smooth and do not form rigid cutting edges as observed in cut edge faces of PP film. When a sheet of kraft paper is combined with a sheet of PP film in such a manner that it has at least one surface thereof bordering on the sheet of PP film, there are derived numerous advantages, including the fact that the cushioning effect of the kraft paper greatly facilitates the control of the inner pressure between adjacent tapes, permits the conditions of cable production to be selected in very wide ranges, and renders the handling of the cable easy such that the adjacent tapes in the produced cable are allowed to slide smoothly over each other and do not suffer mutual displacement because the kraft paper absorbs flexion exerted thereon during manufacturing, shipping and actual installation of the cable. Further, the kraft paper very smoothly absorbs any increase of the thickness of the PP tape due to swelling and thermal expansion and permits the inner pressure between the adjacent tapes to be easily maintained at the optimum level and discourages formation of gaps between the adjacent tapes.

Where two cable ends are joined, it is usual for the unwinding of the insulation layer and the subsequent winding of tapes between the joint of the two cable ends on the joined conductor to be carried out manually. In this case, if the entire insulation were formed exclusively of PP film tapes, it would be rather difficult for the inner inner layer of PP tapes to be tightly wound manually. On the other hand, when PP film and kraft paper are alternately wound as contemplated by this invention, the inner layer can be very easily tightened by winding the kraft paper and the tightly wound condition of the inner layer can be easily retained intact with the kraft paper. Thus, the alternate winding facilitates the work of cable splicing and stabilizes and enhances the quality of the joining portion of the cable. All these factors enhance the mechanical and electric properties of the insulation of the cable of this invention.

Purely from the electrical point of view, plastic film, which lacks a polar group and has carbon and hydrogen atoms arranged very neatly and orderly, is slightly inferior in resistance to corona discharge and discharging stream to kraft paper, which contains a polar group and has carbon and hydrogen atoms distributed randomly. The reason for this difference remains yet to be clarified. This trend is conspicuous particularly with respect to impulse strength, especially, positive impulse strength. As a result of much study, the inventors have found that the combination of kraft paper and the PP film of this invention manifests outstanding properties because the kraft paper gives rise to uniformly distributed barrier interfaces in the insulating layer. This discovery has led to the provision of a cable of excellent electrical strength.

From the standpoint of material costs, even a PP film, one of rather inexpensive plastic materials, is still more than twice as expensive as kraft paper. Thus, the economy of the cable improves as the proportion of kraft paper in the combination of kraft paper and PP film is increased, so far as the performance of the cable with respect to dielectric constant (ε) and loss tangent (tan δ) are concerned.

Thus, the cable of this invention, having alternate windings of kraft paper and PP film, manifests its outstanding effects to the fullest extent.

Figure 2:
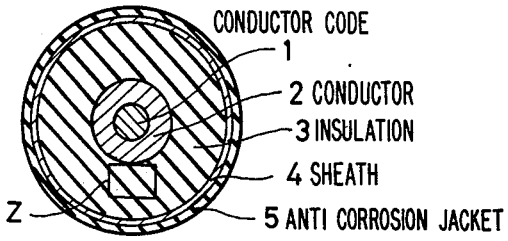
FIG. 2 shows a cross section of an oil-immersion insulated electric power cable.

Now, working examples of the invention will be described with rererence to the accompanying drawings. FIG. 1A is a schematic representation of an insulating layer winding operation. The layer is composed of a plurality of plies. FIG. 2 is a cross section of oil-impregnated electrical insulation 3 wound on the conductor 2, a metallic sheath of aluminum or lead 4 enclosing the oil-impregnated insulation, and an anti-corrosion jacket 5 covering the sheath 4.

Figure 1B:
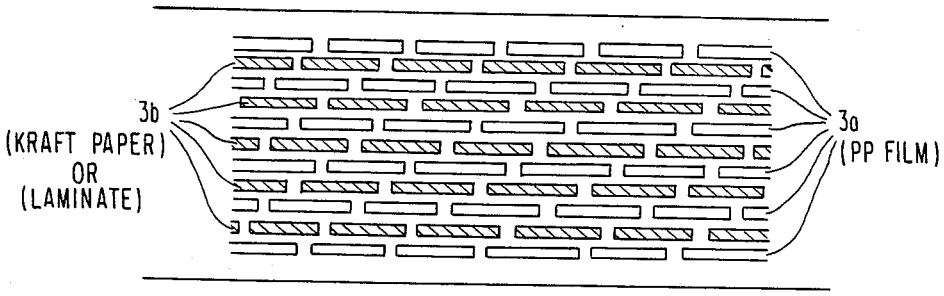
Figure 1C:
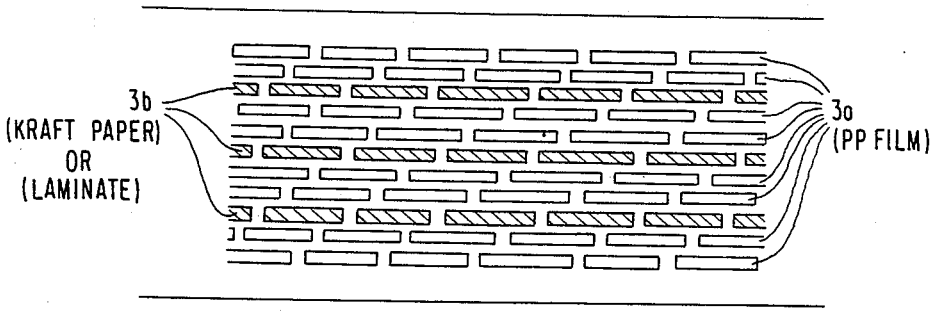

FIG. 1A shows an insulating layer consisting of one ply of ten sheets. The insulating layer could be varied in number and kind of the sheets. For example, FIG. 1B shows a insulating layer wherein a sheet of PP film layer **3*a* and a sheet of kraft paper or laminate 3*b* are arranged alternatively. FIG. 1C shows another insulating layer wherein a sheet of PP film 3*a* and two sheets of kraft paper or laminate 3*b*** are arranged alternatively.

One version of alternate winding is illustrated in FIG. 1B. FIG. 1B is a cross section illustrating a typical insulation structure according to the present invention depicting a portion Z of the cross section of FIG. 2 in the form of an enlarged model. Specifically, FIG. 1B represents one version of the inventive insulation structure wherein sets, each composed of one sheet of PP film **3*a* and one sheet of kraft paper 3*b***, are repeated throughout the entire insulating layer. Since the ratio of PP film and kraft paper in this structure is roughly 1:1, the value of ε·tan δ of the completed cable is intermediate the respective values of ε·tan δ of the two materials. Since this value for kraft paper is $3.4\times0.2\%$ and that of PP film is about $2.2\times0.02\%$, the overall value of the complete cable is equivalent to $2.8\times0.1\%$. With this structure, the dielectric loss is reduced (to the order of $(2.8\times0.1\%)/(3.4\times0.2\%)=0.41$) compared with that of the conventional cable using kraft paper exclusively in the insulation. Thus, the cable of the present invention proves highly useful for the EHV class of 275 to 500 kV.

Since this structure has sheets of kraft paper providing an excellent cushioning effect, each interposed between adjacent sheets of PP film, it can cope easily with any thickness increase of the PP film due to swelling. This structure is produced most easily because it offers ample allowance for surface coarsening of the kraft paper and the PP film and permits ready control of the winding tension of the tapes. Even with respect to flexibility and other mechanical properties of the completed cable, the fact that the kraft paper manifests an excellent cushioning effect is a highly desirable merit. Further, since sheets of kraft paper are interposed between adjacent sheets of PP film and thus are distributed throughout the entire thickness of the insulation providing the effect of a barrier, virtually no loss occurs in the electric breakdown strengths, specifically, the positive impulse breakdown strength measured on the conductor side with the higher stress being the positive pole. The thickness effect of the plastic film, i.e., the loss of breakdown strength which occurs when a layer formed exclusively of sheets of PP film is given an increased thickness, is eliminated. Thus, the cable using this insulation structure also excels electrically.

As described above, the cable of the insulation structure of FIG. 1B is stable and excellent both mechanically and electrically. Thus, it is suitable for use in EHV to UHV classes of 275 to 1000 kV.

For a further reduction in the dielectric loss (which is proportional to the square of the transmission voltage and $\epsilon\cdot\tan\delta$), the cable is required to possess a still lower value of $\epsilon\cdot\tan\delta$. To meet this requirement, the inventors have consequently developed the insulation structure illustrated in FIG. 1C. More specifically, in this structure, sets, each consisting of two sheets of PP film 3*a* and one sheet of kraft paper 3*b* interposed therebetween, are repeated throughout the entire insulation. In this insulation structure, the cushioning effect of the kraft paper and the resistance offered to corona discharge and discharging stream by the barriers of kraft paper are excellent. In the cable using this insulation structure, the dielectric constant ($\epsilon$) is $(2\times2.2+3.4)/3=2.6$ and the dielectric loss tangent ($\tan\epsilon$) is $(2\times0.02\%+0.2\%)/3=0.087\%$. Thus, the value of $\epsilon\cdot\tan\delta$ of this cable is $(2.6\times0.087)/(3.4\times0.2)=0.33$ as compared with the cable using the insulating layer made exclusively of kraft paper. Thus, the cable attains the desired reduction of dielectric loss at substantially no sacrifice of other material and electrical properties.

In this insulation structure, since the mixing ratio of kraft paper as a cushioning component is decreased both locally and overall to two-thirds that in the structure of FIG. 1B, it becomes necessary to slightly ncrease the aforementioned amount of surface coarsening of the PP film and kraft paper and to use a slightly lower winding tension. Nevertheless, since all the sheets of the PP film border on kraft paper and thus make the most of the cushioning effect of the kraft paper, the produced cable proves amply practicable from the standpoint of cable manufacturing and flexibility performance.

From the electrical point of view, although the cable suffers a slight loss in its positive impulse strength, it retains the barrier effect of the kraft paper and the resistance to corona discharge and discharging stream as expected.

The cushioning effect of the kraft paper is derived more safely and desirably by using raw kraft paper containing moisture from the air or moisture-adjusted kraft paper having its thickness increased in advance by the addition of water rather than dry kraft paper having its moisture contact lowered to 1% or lower in advance, for insulation layers made solely of kraft paper. Unlike the winding of dry kraft paper which entails an extra process for drying, special storage for keeping the paper dry, and a taping machine specially designed to permit the paper to be wound in a dry state, the winding contemplated by this invention is easy to perform and quite inexpensive.

The inventors have further improved the breakdown property of the cable as follows. Specifically, they have found it highly desirable to use sheets of kraft paper having a high dielectric constant and high resistance to corona discharge. With this technique, particularly the positive impulse strength of the cable can be improved without suffering any discernible rise of the value of $\epsilon\cdot\tan\delta$ of the cable as a whole.

Figure 3:
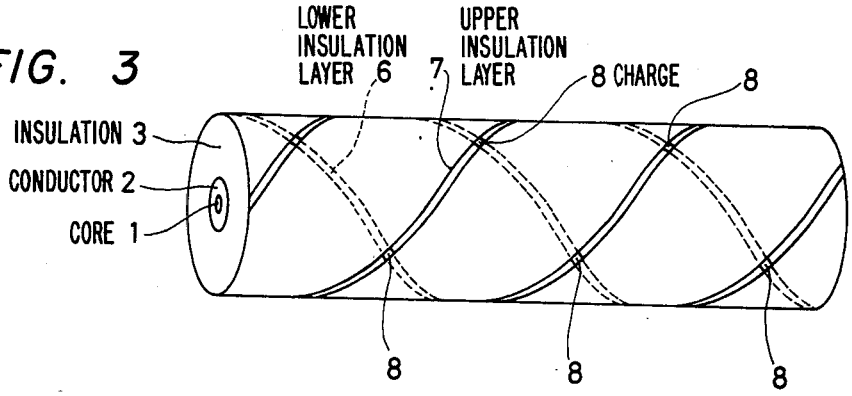
FIG. 3 is a perspective view of an oil-immersion insulating layer in the oil-immersion insulated electric power cable of FIG. 2.

FIG. 3 is a perspective view of oil-impregnated insulation in the oil-impregnated electrically insulated cable and shows the oil gaps and the crossing double oil gaps 8 formed between two tapes of adjacent layers. In this diagram, 6 denotes a lower (left-hand) oil-immersion insulating layer, 7 an upper (right-hand) oil-immersion insulating layer, and 8 an area where a change of layers (change of taping head) occurs and where the depth of the oil gap equals the thickness of two plies of tape. This particular portion constitutes another weak point of the cable.

In otherwords, FIG. 3 shows an outermost insulating layer in a real line and the second outermost insulating layer in a broken line. The two adjacent insulating layers are wrapped in opposite directions, so that the gaps 8 exist.

Figure 4:
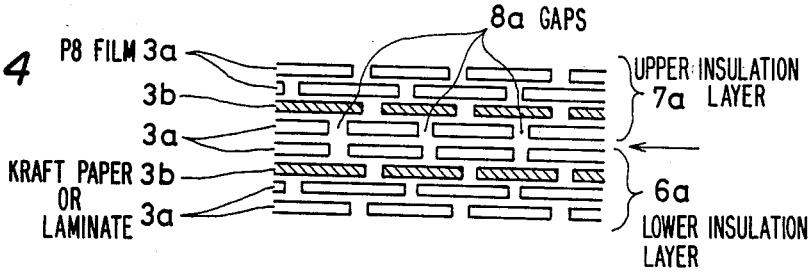
FIG. 4 is a cross section of a typical insulation structure contemplated by the invention, illustrating in an enlarged view a portion of oil-immersion insulating tapes wherein there is a change of layer structure where oil gaps at crossing points shown in FIG. 3 result in a doubling of the normal depth of oil gaps.

To correct for this weak point, the present invention uses tapes of kraft paper, as shown in FIG. 4, in the plies destined to be exposed to the portions 8*a* of the layer change in the oil-immersion insulating layer (the portions indicated by the arrow in FIG. 4) where the depth of the oil gap equals the thickness of two plies of tape, so that any local breakdown of the oil gap 8*a* will be prevented from readily developing into total breakdown of the cable by the barrier effect of the kraft paper. In FIG. 4, plies of PP film are used at the vicinity of layer changes. In particular, FIG. 4 shows a boundary portion of the adjacent insulating layers. Numerals 6 and 7 denote a lower insulating layer and an upper insulating layer, respectively. Numeral 6*a* shows upper four sheets of the lower insulating layer 6 and numeral 7*a* shows lower four sheet of the upper insulating layer 7. Optionally, these two plies may be formed of kraft paper so that a total of four plies of kraft paper are present, two above and two below each point of change of layer. This structure has been demonstrated to be quite effective. Arranging plies of kraft paper at areas of layer change is more effective closer to the conductor side where the electric stress is prominent. Where the mixing ratio of kraft paper is desired to be lowered to reduce the value of $\epsilon \cdot \tan \delta$, it is advantageous to adopt this approach at the area of layer change in only the innermost five or less layers from the boundary of the conductor.

Concerning particularly the loss (decrease) of the positive impulse strength, which demands due attention in the application of the PP film to the cable, improvements are attained notably by the arrangement of the kraft paper. These improvements add all the more to the effectiveness of the cable of the present invention.

The amount of surface coarsening of the PP film and kraft paper contemplated by this invention varies widely with the class of voltage, the size of the conductor, the kind of the cable, and the insulating oil to be used. It is particularly affected by the combination of the specific combination of PP film and insulating oil.

In the cable of the present invention, the combination of PP film with DDB has been demonstrated to enable the cable to attain excellent electrical properties, although other insulating oils can also provide excellent results. For a POF cable, for example, polybutene-type insulating oils of high viscosity are most often used. When such an insulating oil is used, since the amount of swelling of the PP film is small, it suffices to form bosses of a size of 2 to 10 microns, for example, only on the sheets of kraft paper used in the insulation structure of FIG. 1A. Of course, it otherwise suffices to form bosses of a size of about 5 microns only on the sheets of PP film. In the case of the insulation structure of FIG. 1B involving the combination of PP film with DDB, it suffices to form bosses of a size of 6 to 20 microns on all sheets of the PP film, to form bosses of a size of 20 to 40 microns on every other sheet of PP film, or to form bosses of a size of 5 to 10 microns on all the sheets of PP film and bosses of a size of 1 to 5 microns on the sheets of kraft paper. Even with bosses of the combinations as mentioned above, it is possible to optimize the inner pressure between the adjacent tapes throughout the entire insulation by adjusting the tape width and controlling the tape wrapping tension.

The appropriateness of this inner pressure was determined by holding a given cable at the highest working temperature (85° to 95° C., for example) for 24 hours, thereby to amply swell the tapes of PP film, then bending the cable twice alternately in opposite directions into a loop of a diameter about 20 times the outermost diameter of the insulation, and then cutting the cable and visually examining the insulating tapes in the insulation for possible abnormalities.

In any event, it is essential that the cable be manufactured by setting the amount of surface coarsening in the range of 1 to 50 microns, depending on the types of the cable, tape, and insulating oil, and that the paper (tape) wrapping conditions be coordinated with the selected amount of surface coarsening. Once the cable is manufactured, it is often desirable and necessary to swell the tapes of PP films at the highest working temperature of the cable, to conduct a bending test of the swelled cable, and then to examine the quality of the insulation of the cable.

The present invention provides the following outstanding features by providing a cable for which the values of density, birefringence, ratio of strength in two axial directions, and surface roughness of the PP film used in the cable are within the respective ranges herein defined, in which sheets of the PP film and sheets of kraft paper are wrapped in the described manner and either or both of the opposite surfaces of either or both of the PP films and kraft papers are properly coarsened:

(1) The swelling of the cable with the insulating oil is minimal.

(2) The fluidity of the insulating oil between the overlapping plies of the insulating tape is satisfactory.

(3) The cable exhibits outstanding mechanical properties for insulation (insulating layers) and enjoys good workability during the tape wrapping process.

(4) The insulating tapes wound on the conductor neither tighten nor skacken easily.

(5) The winding of insulating tapes at the joint of two cable ends is easy and the insulating layers so formed are reliable.

(6) The cable can be manufactured with any desired choice of combinations of the PP film and kraft paper so that required properties of both dielectric constant and dielectric loss tangent can be provided with no sacrifice of economy.

(7) The cable excels in dielectric strength. It particularly is excellent in impulse strength.

The terms and methods of measurement as used in the present invention are described below:

(1) Isotacticity: A given PP sample is extracted from boiling N-heptane. The weight of the extracted residue is divided by the original weight of the sample. The quotient is multiplied by 100. The product, expressed as a percent, is used to represent the isotacticity.

(2) Melt index: This physical property is measured under the conditions L of ASTM D-1238-73.

(3) Temperature of melt crystallization ($T_{mc}$): A sample 5 mg in weight is placed in a tester, for instance, Model DSC-II, made by Perkin Elmer Corp., with the atmosphere inside the tester displaced with nitrogen. Then, the sample is heated to raise its temperature at a rate of 20° C./minute to 200° C. and then held at this level of 200° C. for five minutes. Then, the hot sample is cooled at a rate of 20° C./minute, causing in the meantime the tester to describe a peak of the heat generated as a consequence of the crystallization of the molten sample. The temperature at the apex of the curve so described is reported as $T_{mc}$.

(4) Density: This property is measured in accordance with ASTM D-1505.

(5) Birefringence: By the use of an Abbe refractometer, the refractive index in the longitudinal direction ($N_y$) and that in the lateral direction ($N_x$) of a given sample of film are measured. The difference obtained by subtracting $N_x$ from $N_y$ is the birefringence. In the measurement, a sodium D ray is used as the light source and methyl salicylate as the mounting medium.

(6) Ratio of strengths in two axial directions: The tensile strength in the longitudinal direction, $\sigma_y$ (kg/mm$^2$), and the tensile strength in the lateral direction, $\sigma_x$ (kg/mm$^2$) of a sample of film are measured by the method of ASTM D-882-67. The quotient of $\sigma_y$ divided by $\sigma_x$ represents the ratio of strengths.

(7) Surface roughness ($R_{max}$): The roughness, $R_{max}$, of a sample of film is measured by the method described in JIS B-0601-1976. The cutoff value is fixed at 0.5 mm.

(8) Ratio of thermal shrinkage: A specimen 200 mm in length an 10 mm in width is cut from a sample of film, with the longitudinal direction of the specimen taken as the direction of measurement of this ratio. The specimen is held for 15 minutes in an oven in which hot air at 120° C. is circulated. After this, the specimen is removed from the oven and measured for length (in mm)

found by the measurement, the ratio of thermal shrinkage is defined by the following equation:

$$\text{Ratio of thermal shrinkage (\%)} = 100 \times (220 - L)/200.$$

(9) Degree of swelling of cable insulating layer with insulating oil:

A lamination of a desired number of specimens each 30 mm×30 mm is subjected to a pressure of about 1 kg/cm$^2$ by a spring. The thickness of the lamination in the wound state is noted as $t_1$. In this state, the lamination is dried to a desired extent and then immersed in insulating oil. It is next heated to a temperature to be tested, for example, 85° to 95° C., and kept as it is for 4 to 24 hours to swell the PP film completely. The thickness of the lamination swelled completely is noted as $t_2$. Then, the degree of swelling (%) is found in accordance with the following equation:

$$\text{Degree of swelling (\%)} = 100 \times \frac{t_1 - t_2}{t_2}.$$

(10) Fluidity of insulating oil:

A sample of film is wrapped around a conductor to form a cable. This cable is immersed in the insulating oil and then impregnated with the oil under a vacuum. Thereafter, the cable is disassembled and visually examined to determine whether or not the insulating oil has been dispersed in all gaps in all the plies of the film. A rating is made on a three-point scale defined as follows.

Rank A: Thorough uniform dispersion of the oil throughout the gaps.

Rank B: There are points at which slight insufficiency of oil dispersion occurs.

Rank C: There are planes in which total absence of oil dispersion occurs.

For use as an oil-immersion insulating material, the film is required to be rated as Rank A. In applications to low voltage cables, a film rated as Rank B may be acceptable. A film rated as Rank C should be rejected as an oil-immersion insulating material.

(11) Electrically insulating oil: This is a generic term applicable to all known electrically insulating oils such as mineral oil, castor oil, cottonseed oil, alkylbenzene, diallyl alkanes, polybutene oil, and silicone oil.

The present invention will now be described more specifically below with reference to actual examples and comparative examples.

A volume of PP resin pellets having an isotactic structure content of 97.6%, melt index of 6 g/10 minute, and a $T_{mc}$ of 110.5° C. were supplied to an extruder and melt extruded through a T-shaped die at 260° C. in the form of a sheet. The molten sheet was wound on a cooling drum at 30° C. and allowed to cool and solidify to produce a sheet about 1000 microns in thickness. This sheet was passed between a set of reducing rolls (roll diameter 250 mm) and rolled to about 9 times the original length. The rolling was carried out with a rolling pressure of 500 kg/cm and roll temperature of 140° C. The sheet surface was wetted with polyethylene glycol. The rolled film about 90 microns in thickness was introduced into an atmosphere at 130° C. and subjected to a 10-second heat treatment, causing it to slacken by 1% in the longitudinal direction. Then, the film was passed between embossing rolls held at 130° C. to transfer print a sand blast pattern about 100 mesh in surface roughness on both surfaces of the film. The film, in a tense state, was held for 10 hours in the ambient atmosphere at 120° C. to carry out an aging heat treatment and thereafter left to cool gradually to room temperature. This film was cut into tapes 22 mm in width.

The properties exhibited by the PP film were as follows:

| | |
|---|---|
| Density (g/cm$^3$): | 0.910 |
| Birefringence: | 0.030 |
| Ratio of strengths in two axial directions: | 10.2 |
| Ratio of thermal shrinkage (%): | 1.3 |
| Surface roughness ($R_{max}$) (microns): | 12.5 |
| Degree of swelling (%): | 3.1 |
| Average thickness of PP film (microns): | 100 |

For comparison, a commercially available nonstretched PP film and a biaxially oriented PP film were tested for the same properties. The results were as follows:

| | Nonstretched PP film | Biaxially oriented PP film |
|---|---|---|
| Density | 0.899 | 0.905 |
| Birefringence | 0.003 | 0.013 |
| Ratio of strength in two axial directions | 4.3 | 1.9 |
| Ratio of thermal shrinkage (%) | 0 | 2.8 |
| Surface roughness ($R_{max}$) (microns) | 0.6 | 0.9 |
| Degree of swelling (%) of flat PP film at 80° C. | 11.6 | 6.3 |

The properties of the kraft paper used in combination with the PP film were as follows:

| | |
|---|---|
| Density (g/cm$^3$): | 0.80 |
| Airtightness (Gurley · sec): | About 3000 |
| Thickness (microns): | 100 |

Tapes 22 mm in width of the kraft paper were wound with one-third overlap on a stranded conductor 200 mm$^2$ in cross section in a varying structure as indicated in Table 1 below. The cables consequently obtained were dried and then impregnated with DDB at room temperature and left to stand at 100° C. for 48 hours for thorough swelling of the PP film. The cables were allowed to cool to normal room temperature, bent twice alternately in opposite directions into a loop of a diameter about 20 times the diameter of the insulating layer, and disassembled for visual inspection of the condition of the insulating layers.

TABLE 1

| | Sample No. | | | | | | | | |
|---|---|---|---|---|---|---|---|---|---|
| | 1 | 2 | 3 | 4 | 5 | 6 | 7 | 8 | 9 |
| PP film | Kraft paper only | Rolled PP only | Biaxially oriented PP only | Non-stretched PP only | Rolled PP | Biaxially oriented PP only | Non-stretched PP only | Rolled PP | Rolled PP |
| Sample | (1) | (1) | (1) | (1) | (1) | (1) | (1) | (1) | (1) |

TABLE 1-continued

| | Sample No. | | | | | | | | |
|---|---|---|---|---|---|---|---|---|---|
| | 1 | 2 | 3 | 4 | 5 | 6 | 7 | 8 | 9 |
| structure | One layer consist of six plies (2) three plies | One layer consist of six plies (2) three plies | One layer consist of six plies (2) three plies | One layer consist of six plies (2) three plies | One layer consist of six plies (2) three plies (3) Alternate combination of kraft and PP film, 1:1 | One layer consist of six plies (2) three plies (3) Alternate combination of kraft and PP film, 1:1 | One layer consist of six plies (2) three plies (3) Alternate combination of kraft and PP film, 1:1 | One layer consist of six plies (2) three plies (3) Alternate combination of kraft and PP film, 1:2 | One layer consist of six plies (2) three plies (3) Alternate combination of kraft and PP film, 1:2 (4) Kraft used in second upper and lower plies at point of change of layer; kraft used in two innermost upper and lower plies. |
| Results of disection test | No abnormality | Slight scratches at points of change of layer | Gaps disturbed and collapsed | Heavy defects of gaps | No abnormality | Gaps disturbed, collapse of PP film in gaps | Heavy defects of gaps, tear in kraft paper | No abnormality | No abnormality |
| Dielectric constant ($\epsilon$) | 3.4 | 2.2 | 2.2 | 2.2 | 2.8 | 2.8 | 2.8 | 2.55 | 2.75 |
| Dielectric loss tangent (tan $\delta$) (%) | 0.23 | 0.02 | 0.03 | 0.03 | 0.10 | 0.11 | 0.11 | 0.080 | 0.092 |
| | Impulse ref. | | | | | | | | |
| Minus impulse | 1.0 | 1.6 | 1.4 | 0.9 | 1.8 | 1.5 | 1.1 | 1.75 | 1.7 |
| Plus impulse | 0.95 | 1.2 | 1.1 | 0.6 | 1.45 | 1.3 | — | 1.35 | 1.55 |
| AC | 1 | 1.8 | 1 | 0.8 | 1.5 | — | — | 1.6 | 1.5 |
| Fluidity of insulating oil | A | A | B | C | A | A | A | A | A |

From these results, it is noted that the insulation formed in accordance with the invention by winding swells only slightly with the insulating oil, shows good fluidity of the insulating oil and good bending properties, possesses a high impulse strength, experiences only nominal loss of positive impulse strength, permits attainment of the desired value of $\epsilon \cdot \tan \delta$, and, therefore, proves highly advantageous for use in the production of an oil-immersion electrically insulated cable.

As mentioned hereinbefore, the inventors have succeeded in realizing an oil-impregnated insulating power cable which is of high quality and high practicability by using a specific combination of PP film and kraft paper.

The reduction of the loss factor ($\epsilon \cdot \tan \delta$) is, however, limited by the total amount of the kraft paper as mentioned previously. In order to reduce the loss factor, it would be necessary to reduce the total amount of the kraft paper in the insulation by employing a kraft paper thinner than 70 microns, the lower limit value of the thickness of single kraft paper sheet, which is undesirable for the reasons mentioned before. According to the present invention, however, a thinner kraft paper can be used together with PP film. The PP film to be used together with the thinner kraft paper should be a low-swelling PP film which is melt-extruded between the two thinner kraft papers. Such kraft paper is superior in its cushioning effect and insulating characteristics. Specifically, two sheets of kraft paper sandwich the low-swelling, melt-extruded PP film to form a multiple- (in this case, three-) layer laminated structure, referred to as PP laminated paper, to be used as a substitute for the kraft paper. An illustration of a typical laminate structure is shown in FIG. 1D. Table 2 shows examples of specifications of the PP laminated paper.

TABLE 2

| Sample lamination | A | B | C |
|---|---|---|---|
| Total thickness ($\mu$m) | 125 | 155 | 200 |
| PP thickness ($\mu$m) | 45 | 55 | 80 |
| Paper thickness ($\mu$m) | 40.40 | 40.60 | 60.60 |
| Density (g/cm$^3$) | 0.88 | 0.90 | 0.90 |
| Deg. of Swelling at 100° C. (%) | 4.0 | 3.8 | 3.3 |
| $\epsilon$ | 2.75 | 2.79 | 2.81 |
| tan $\delta$ (%) | 0.07 | 0.08 | 0.09 |
| $\epsilon \cdot \tan \delta$ (%) | 1.9 × 0.1 | 2.2 × 0.1 | 2.5 × 0.1 |

Assuming a value of $\epsilon \cdot \tan \delta$ of the PP laminated paper of $2.8 \times 0.1\%$, the value of $\epsilon \cdot \tan \delta$ of the cable having an insulation prepared by alternately winding the PP film and a sheet of the PP laminated paper is:

$$[(2.2+2.8)/2] \cdot [(0.02\%+0.1\%)/2] = 2.5 \times 0.06\%.$$

The value of $\epsilon \cdot \tan \delta$ of a cable having insulation prepared by winding a combination tape of a sheet of PP laminated paper and two sheets of PP film is:

$$[(2.2 \times 2+2.8)/3] \cdot (0.02\% \times 2+0.1\%)/3] = 2.4 \times 0.047\%.$$

The ratios of these values to those of a cable having insulation composed of only the kraft paper are, respectively, as follows:

$$(2.5 \times 0.06)/(3.4 \times 0.2) = 0.22, \text{ and}$$

$$(2.4 \times 0.047)/(3.4 \times 0.2) = 0.17.$$

As is clear from these ratios, the use of the PP laminated paper according to the present invention results in a remarkably reduced loss in the cable.

Table 3 shows comparative data of cables having insulation composed of combinations of PP films and the PP laminated papers. In Table 3, sample no. 1 is the same as sample no. 1 in Table 1.

TABLE 3

| Sample No. | 1 | 10 | 11 |
|---|---|---|---|
| insulating tape | kraft paper | rolled PP film and PP laminated paper | rolled PP film and laminated paper |
| sample structure | (1) one layer of six plies | (1) rolled PP film and PP laminated paper | (1) rolled PP film and laminated paper |
| | | (2) rolled PP film and PP laminated paper | (2) rolled PP film and laminated paper |
| | (2) three layers | (3) alternate combination of a laminated PP paper and a PP film | (3) alternate combination of a laminated PP paper and two PP film sheets |
| $\epsilon$ | 3.4 | 2.52 | 2.43 |
| tan $\delta$ (%) | 0.23 | 0.055 | 0.049 |
| negative impulse | 1.0 | 1.9 | 1.8 |
| positive impulse | 0.95 | 1.4 | 1.4 |
| fluidity of insulating oil | A | A | A |
| results of disection test | no abnormality | A | A |

As is clear from Table 3, the test results for samples Nos. 10 and 11 show that these are usable in practice. In producing a cable on the basis of either sample No. 10 or No. 11, it may be necessary to roughen the surfaces of the PP film to the extent of 20 to 40 microns or to roughen the surfaces of the PP film to the extent of 5 to 10 microns and those of the PP laminated paper to the extent of 3 to 10 microns, while the tension of the tape when wound is controlled to be sufficiently small.

Figure 5:
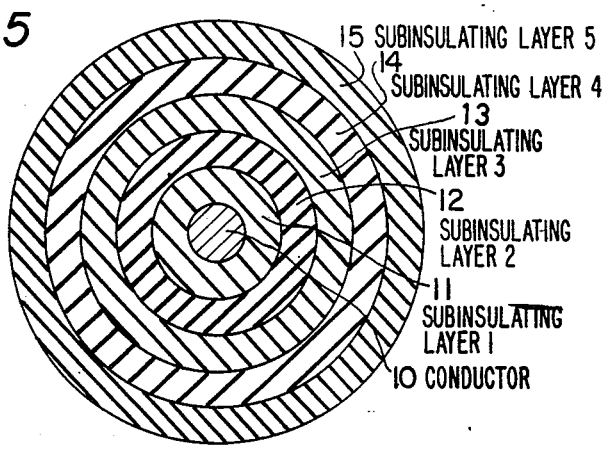
FIG. 5 is a cross section of a second embodiment of the invention illustrating $\epsilon$-grading.

According to another embodiment of the present invention shown in FIG. 5, the high stress generated around the conductor 10 of an AC cable can be minimized to further improve the dielectric breakdown strength of the insulation thereof by employment of a so-called "$\epsilon$-grading system". In the "$\epsilon$-grading system" each sheet of the subinsulation 11 adjacent the conductor 10 has a value of $\epsilon$ which is reduced in relation to the distance of the sheet from the conductor. According to this embodiment, use of the $\epsilon$-grading system permits the thickness of the insulation to be reduced and, thus, the size of such a cable can be reduced. It is important to the reduction of $\epsilon \cdot \tan \delta$ to reduce the size of the cable by reducing the total thickness of the insulation layers. This is particularly true for cable used in the EHV to UHV classes.

In FIG. 5, the insulation is composed of five subinsulation layers 11 to 15, in which the subinsulation layer 11 is formed of kraft paper, the subinsulation layer 12 of an alternating combination of a sheet of kraft and a sheet of the PP film, the subinsulation layer 13 of an alternating combination of a sheet of kraft paper and two sheets of the PP film, the subinsulation layer 14 of an alternating combination of a sheet of the PP laminated paper and a sheet of the PP film, and the subinsulation layer 15 of an alternating combination of a sheet of the PP laminated paper and two sheet of the PP films.

Table 4 shows data of a typical example of the $\epsilon$-graded cable shown in FIG. 5.

TABLE 4

| | Subinsulation Layer | Construction | $\epsilon \cdot \tan \delta$ (%) |
|---|---|---|---|
| Conductor side | 11 | kraft paper | 3.4 × 0.2 |
| | 12 | alternate combination of a kraft paper sheet and a rolled PP film sheet | 2.8 × 0.1 |
| | 13 | alternate combination of a kraft paper sheet and two rolled PP film sheets | 2.6 × 0.087 |
| | 14 | alternate combination of a PP laminated paper sheet and a rolled PP film sheet | 2.5 × 0.06 |
| outer surface of insulation | 15 | alternate combination of a PP laminated paper sheet and two rolled PP film sheets | 2.4 × 0.047 |

In Table 4, the dielectric loss ($\epsilon \cdot \tan \delta$) of the kraft paper, the PP laminated paper, and the inventive low-swelling PP film are about 3.4×0.2 (%), 2.8×0.1 (%) and 2.2×0.02 (%), respectively. One or more subinsulation layers among the subinsulation layers 1 to 5 in Table 4 may be omitted, if necessary, according to the class of the cable.

The inventive cable, employing $\epsilon$-graded insulation, exhibits an improvement of the dielectric breakdown voltage by 3 to 10% relative to a cable without $\epsilon$ graduation.

The present invention may be embodied in any of several different combinations of insulation layers. The layers may comprise one or more sheets of material such as polypropylene, kraft paper and a laminate, which is a sandwich of a polypropylene adhesive and two sheets of an electrically insulating paper such as kraft paper. A cross section of a laminate is seen in FIG. 1D.

One example of such layer is seen in FIG. 1B, as previously described, where one sheet of polypropylene is alternated with one sheet of kraft paper or laminate. Another example of such layer is seen in FIG. 1C, as previously described, where two sheets of polypropylene are alternated with one sheet of kraft paper or laminate.

These layers may be assembled as a single combination of sheets or alternating combinations of sheets. Consequently, several embodiments of the present invention are possible and are described below and illustrated in the drawings to show a variety of constructions for the insulating layer.

Figure 6:
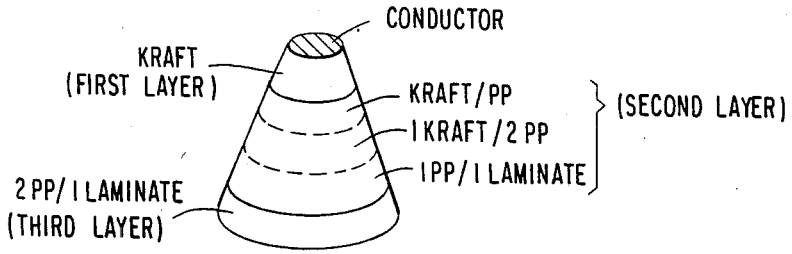
FIG. 6 is a cross section of a third embodiment of the invention.

FIG. 6 shows a sector of a cross section of a third embodiment in which the conductor is wrapped by an inner insulating layer of kraft paper, followed by an intermediate insulating layer comprising first, second and third sublayers, the first sublayer being an alternating combination of a sheet of kraft paper and a sheet of polypropylene film, the second sublayer comprising an alternating combination of a sheet of kraft paper and two sheets of polypropylene film and the third sublayer comprising an alternating combination of one sheet of polypropylene film and a laminate of a sheet of polypropylene sandwiched by two sheets of kraft paper, followed by an outer layer formed by an alternating combination of two sheets of polypropylene film and a laminate comprising an electrically insulating paper bonded together with a single polypropylene adhesive.

Figure 7:
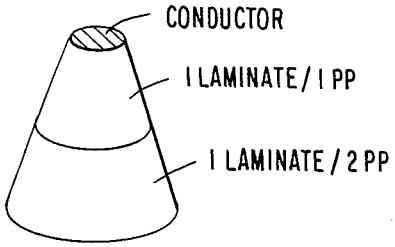
FIG. 7 is a cross section of a fourth embodiment of the invention.

FIG. 7 shows sector of a cross section of a fourth embodiment in which the conductor is wrapped, in order from the conductor, with at least a first layer comprising one sheet of laminate and one sheet of polypropylene (as in FIG. 1B) followed by a second layer comprising one sheet of laminate and two sheets of polypropylene (as in FIG. 1C).

Figure 8:
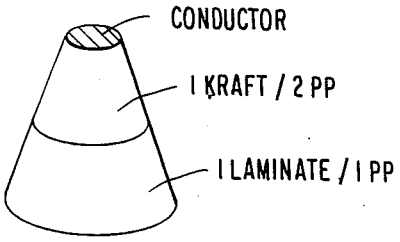
FIG. 8 is a cross section of a fifth embodiment of the invention.

FIG. 8 shows a sector of a cross section of a fifth embodiment in which the conductor is wrapped, in order from the conductor, with at least a first layer comprising one sheet of kraft paper and two sheets of polypropylene followed by a second layer comprising one sheet of laminate and one sheet of polypropylene.

Figure 9:
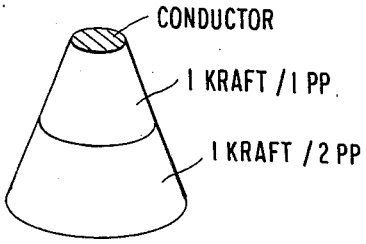
FIG. 9 is a cross section of a sixth embodiment of the invention.
Figure 10:
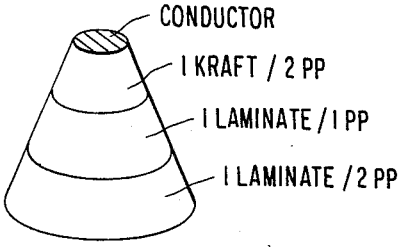

FIG. 9 shows a sector of a cross section of a sixth embodiment in which the conductor is wrapped, in order from the conductor, with at least a first layer comprising one sheet of kraft paper and one sheet of polypropylene followed by a second layer comprising one sheet of kraft paper and two sheets of polypropylene.

Figure 10:
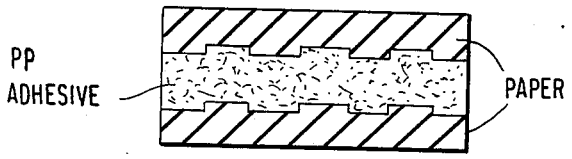
FIG. 10 is a cross section of a seventh embodiment of the invention.

FIG. 10 shows a sector of a cross section of a seventh embodiment in which the conductor is wrapped, in order from the conductor, with at least a first layer comprising one sheet of kraft paper and two sheets of polypropylene, followed by a second layer comprising one sheet of laminate and one sheet of polypropylene, followed by a third layer comprising one sheet of laminate and two sheets of polypropylene.

Figure 11:
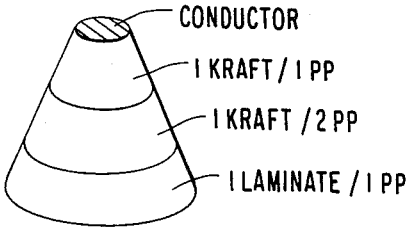
FIG. 11 is a cross section of a eighth embodiment of the invention.

FIG. 11 shows a sector of a cross section of a eighth embodiment in which the conductor is wrapped, in order from the conductor, with at least a first layer comprising one sheet of kraft paper and one sheet of polypropylene, followed by a second layer comprising one sheet of kraft paper and two sheets of polypropylene, followed by a third layer comprising one sheet of laminate and one sheet of polypropylene.

Figure 12:
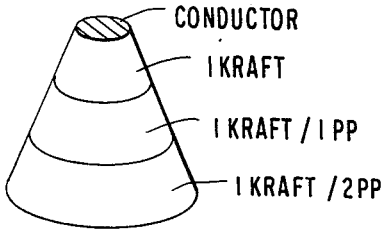
FIG. 12 is a cross section of a ninth embodiment of the invention.

FIG. 12 shows a sector of a cross section of a ninth embodiment in which the conductor is wrapped, in order from the conductor, with at least a first layer comprising one sheet of kraft paper, followed by a second layer comprising one sheet of kraft paper and one sheet of polypropylene, followed by a third layer comprising one sheet of kraft paper and two sheets of polypropylene.

Figure 13:
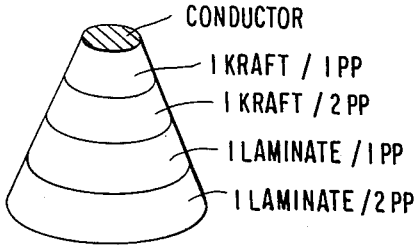
FIG. 13 is a cross section of a tenth embodiment of the invention.

FIG. 13 shows a sector of a cross section of a tenth embodiment in which the conductor is wrapped, in order from the conductor, with at least a first layer comprising one sheet of kraft paper and one sheet of polypropylene, followed by a second layer comprising one sheet of kraft paper and two sheets of polypropylene, followed by a third layer comprising one sheet of laminate and one sheet of polypropylene, followed by a fourth layer comprising one sheet of laminate and two sheets of polypropylene.

Figure 14:
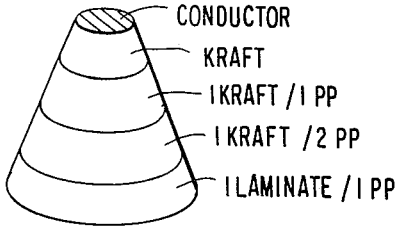
FIG. 14 is a cross section of a eleventh embodiment of the invention.

FIG. 14 shows a sector of a cross section of an eleventh embodiment in which the conductor is wrapped, in order from the conductor, with at least a first layer comprising one sheet of kraft paper, followed by a second layer comprising one sheet of kraft paper and one sheet of polypropylene, followed by a third layer comprising one sheet of kraft paper and two sheets of polypropylene, followed by a fourth layer comprising one layer of laminate and one layer of polypropylene.

Figure 15:
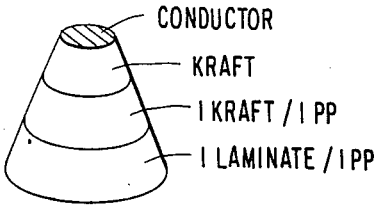
FIG. 15 is a cross section of a twelfth embodiment of the invention.

FIG. 15 shows a sector of a cross section of a twelfth embodiment in which the conductor is wrapped, in order from the conductor, with at least a first layer comprising one sheet of kraft paper, followed by a second layer comprising one sheet of kraft paper and one sheet of polypropylene, followed by a third layer comprising one sheet of laminate and one sheet of polypropylene.

As described hereinbefore, the insulating oil impregnated power cables according to the present invention which utilize as at least portions of its insulation an inventive PP film having low swelling and good mechanical properties and kraft paper of a natural polar material or a PP laminated paper with at least portions thereof being roughened, exhibits remarkable improvements in dielectric loss, dielectric breakdown voltage, compactness and reliability.

I claim:

1. An electric power cable, comprising:

a conductor;

insulation surrounding said conductor, said insulation having at least portions thereof formed by winding on said conductor polypropylene film having a density in a range of 0.905 to 0.915 g/cm$^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

2. The electric power cable according to claim 1, wherein said insulation further comprises kraft paper, said kraft paper being wound around said conductor alternately with said polypropylene film.

3. The electric power cable according to claim 2, wherein an alternate winding of polypropylene film and kraft paper comprises at least a combination of one sheet of polypropylene film and one sheet of kraft paper.

4. The electric power cable according to claim 2 wherein an alternate winding of polypropylene film and kraft paper comprises at least a combination of two sheets of polypropylene sheet and one sheet of kraft paper.

5. The electic power cable according to claim 2, wherein a portion of said surfaces of said polypropylene film and kraft paper have a roughness in a range of 1 to 50 microns.

6. The electric power cable according to claim 2, wherein said kraft paper comprises raw kraft paper.

7. The electric power cable according to claim 2, wherein said kraft paper comprises moisture-conditioned raw kraft paper.

8. The electric power cable according to claim 2, wherein said insulating oil comprises dodecyl benzene.

9. The electric power cable according to claim 2, wherein said cable is conditioned by heating for 24 to 48 hours at a highest expected operating temperature prior to shipment.

10. The electric power cable according to claim 1, wherein said insulation comprises a plurlity of layers, said layers comprising a combination of kraft paper and polypropylene film.

11. The electric power cable according to claim 10, wherein one of said layers comprises 3 to 10 plies of said kraft paper.

12. The electric power cable according to claim 10, wherein there are more than five layers and, in the innermost five layers, alternate ones of said layers are wound in opposite directions, and wherein, at gaps formed at intersections between adjacent ones of said layers, plies laterally adjacent to said gap are formed of said kraft paper.

13. The electric power cable according to claim 1, wherein said insulation comprises an electrically insulating paper laminate comprising two sheets of electrically insulating paper bonded together with a single polypropylene adhesive layer melt extruded between said sheets, said laminate being wound on said conductor alternately with said polypropylene film.

14. The electric power cable according to claim 13, wherein at least one alternate winding of polypropylene film and said laminate is a combination of one sheet of polypropylene film and one sheet of said laminate.

15. The electric power cable according to claim 13, wherein at least one alternate winding of polypropylene film and said laminate is a combination of two sheets of polypropylene sheet and one sheet of said laminate.

16. The electric power cable according to claim 13, wherein a portion of either or both surfaces of at least a portion of said polypropylene film and said laminate have a roughness in a range of 1 to 50 microns.

17. The electric power cable according to claim 13, wherein said laminate comprises raw laminate.

18. The electric power cable according to claim 13, wherein said laminate comprises moisture-conditioned raw laminate.

19. The electric power cable according to claim 13, wherein said insulating oil comprises dodecyl benzene.

20. The electric power cable according to claim 13, wherein said cable is conditioned by heating for 24 to 48 hours at a highest expected operating temperature prior to shipment.

21. The electric power cable according to claim 13, wherein said insulation comprises a plurality of layers, each of said layers comprising a plurality of plies of tapes.

22. The electric power cable according to claim 14, wherein said insulation further comprising kraft paper.

23. The electric power cable according to claim 22, wherein a layer of said insulation comprises 3 to 10 plies of said kraft paper.

24. The electric power cable according to claim 10, wherein there are more than five layers and, in the innermost five layers, alternative ones of said layers are wound in opposite directions, and wherein, at gaps formed at intersections between adjacent ones of said layers, plies laterally adjacent to said gap are formed of said kraft paper.

25. An electric power cable, comprising:

a conductor;

insulation formed around said conductor, said insulation comprising an inner insulating layer, an intermediate insulating layer, and an outer insulating layer, said insulating layers having different dielectric constants such that a dielectric constant of said insulating layers is sequentially graded with the largest value constant at said inner layer and the smallest value constant at said outer layer, at least said outer insulating layer including polypropylene film having a density in a range of 0.905 to 0.915 $g/cm^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

26. The electric power cable according to claim 25, wherein said insulation further comprising kraft paper.

27. The electric power cable according to claim 26, wherein a layer of said insulation comprises 3 to 10 plies of said kraft paper.

28. The electric power cable according to claim 27, wherein there are more than five layers and, in the innermost five layers of said insulation, alternate ones of said layers are wound in opposite directions, and wherein, at gaps formed at intersections between adjacent ones of said layers, plies laterally adjacent to said gap are formed of said kraft paper.

29. The electric power cable according to claim 27, wherein said kraft paper comprises raw kraft paper.

30. The electric power cable according to claim 27, wherein said kraft paper comprises moisture-conditioned raw kraft paper.

31. The electric power cable according to claim 25, wherein said insulation oil comprises dodecyl benzene.

32. The electric power cable according to claim 25, wherein said cable is conditioned by heating for 24 to 48 hours at a highest expected operating temperature prior to shipment.

33. The electric power cable according to claim 25, wherein said inner insulating layer is formed of kraft paper and said outer insulating layer is formed of an alternating combination of two sheets of polypropylene film and an electrically insulating paper laminate comprising two sheets of electrically insulating paper bonded together with a single polypropylene adhesive layer melt extruded between said sheets, said laminate being wound on said conductor alternately with said polypropylene film.

34. The electric power cable according to claim 33, wherein said intermediate insulating layer comprises an alternating combination of a sheet of kraft paper and a sheet of said polypropylene film.

35. The electric power cable according to claim 33, wherein said intermediate insulating layer comprises an alternating combination of a sheet of kraft paper and two sheets of polypropylene film.

36. The electric power cable according to claim 33, wherein said intermediate insulating layer comprises an alternating combination of a sheet of polypropylene film and said laminate.

37. The electric power cable according to claim 33, wherein said intermediate insulating layer comprises first, second and third insulating layers, said first insulating layer comprising an alternating combination of a sheet of kraft paper and a sheet of polypropylene film, said second insulating layer comprising an alternating combination of a sheet of kraft paper and two sheets of polypropylene film, and said third insulating layer comprising an alternating combination of a sheet of polypropylene film and a laminate of a sheet of polypropylene and two sheets of kraft paper sandwiching said polypropylene film sheet.

38. The electric power cable according to claim 32, wherein at least a portion of at least one surface of at least one of said kraft paper, said polypropylene film, and said laminate has a surface roughness in a range of 1 to 50 microns.

39. An electric power cable, comprising:

a conductor;

insulation formed around said conductor, said insulation comprising, in order from said conductor, at least a layer comprising one laminate and one sheet of polypropylene film followed by a layer comprising one laminate and two sheets of polypropylene film, said polypropylene film having a density in a range of 0.905 to 0.915 g/cm$^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

40. An electric power cable, comprising:

a conductor;

insulation formed around said conductor, said insulation comprising, in order from said conductor, a layer comprising one sheet of kraft paper and two sheets of polypropylene film and a layer comprising one laminate and one sheet of polypropylene film, said polypropylene film having a density in a range of 0.905 to 0.915 g/cm$^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

41. An electric power cable, comprising:

a conductor;

insulation formed around said conductor, said insulation comprising, in order from said conductor, a layer comprising one sheet of kraft paper and one sheet of polypropylene film and a layer comprising one sheet of kraft paper and two sheets of polypropylene film, said polypropylene film having a density in a range of 0.905 to 0.915 g/cm$^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

42. An electric power cable, comprising:

a conductor;

insulation formed around said conductor, said insulation comprising, in order from said conductor, a layer comprising one sheet of kraft paper and two sheets of polypropylene film, a layer comprising one laminate and one sheet of polypropylene film, and a layer comprising one laminate and two sheets of polypropylene film, said polypropylene film having a density in a range of 0.905 to 0.915 g/cm$^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

43. An electric power cable, comprising:

a conductor;

insulation formed around said conductor, said insulation comprising, in order from said conductor, a layer comprising one sheet of kraft paper and one sheet of polypropylene film, a layer comprising one sheet of kraft paper and two sheets of polypropylene film, and a layer comprising one laminate and one sheet of polypropylene film, said polypropylene film having a density in a range of 0.905 to 0.915 g/cm$^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

44. An electric power cable, comprising:

a conductor;

insulation formed on said conductor, said insulation comprising, in order from said conductor, a layer comprising one sheet of kraft paper, a layer comprising one sheet of kraft paper and one sheet of polypropylene film, and a layer comprising one sheet of kraft paper and two sheets of polypropylene film, said polypropylene film having a density in a range of 0.905 to 0.915 g/cm$^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

45. An electric power cable, comprising:

a conductor;

insulation formed on said conductor, said insulation comprising, in order from said conductor, a layer comprising one sheet of kraft paper and one sheet of polypropylene film, a layer comprising one sheet of kraft paper and two sheets of polypropylene film, a layer comprising one laminate and one sheet of polypropylene film, and a layer comprising one laminate and two sheets of polypropylene film, said polypropylene film having a density in a range of 0.905 to 0.915 g/cm$^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

46. An electric power cable, comprising:

a conductor;

insulation formed around said conductor, said insulation comprising, in order from said conductor, a layer comprising one sheet of kraft paper, a layer comprising one sheet of kraft paper and one sheet of polypropylene film, a layer comprising one sheet of kraft paper and two sheets of polypropylene film, and a layer comprising one laminate and one sheet of polypropylene film, said polypropylene film having a density in a range of 0.905 to 0.915 g/cm$^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

47. An electric power cable, comprising:

a conductor;

insulation formed on said conductor, said insulation comprising, in order from said conductor, a layer comprising one sheet of kraft paper, a layer comprising one sheet of kraft paper and one sheet of polypropylene film, and a layer comprising one laminate and one sheet of polypropylene film, said polypropylene film having a density in a range of 0.905 to 0.915 g/cm$^3$, a birefringence in a range of 0.020 to 0.035, a ratio of a lengthwise tensile strength to a widthwise tensile strength in a range of 5 to 15, and a thickness in a range of 70 to 300 microns; and insulating oil with which said insulation is impregnated.

* * * * *